US010920510B2

(12) United States Patent
Egleton et al.

(10) Patent No.: US 10,920,510 B2
(45) Date of Patent: Feb. 16, 2021

(54) DOWNHOLE ANCHOR

(71) Applicant: Weatherford U.K. Limited, Leicestershire (GB)

(72) Inventors: Philip C G Egleton, Newmachar (GB); Stephen Reid, Aberdeen (GB)

(73) Assignee: WEATHERFORD U.K. LIMITED, Leicestershire (GB)

( * ) Notice: Subject to any disclaimer, the term of this patent is extended or adjusted under 35 U.S.C. 154(b) by 221 days.

(21) Appl. No.: 15/515,406

(22) PCT Filed: Oct. 14, 2015

(86) PCT No.: PCT/GB2015/053025
§ 371 (c)(1),
(2) Date: Mar. 29, 2017

(87) PCT Pub. No.: WO2016/059400
PCT Pub. Date: Apr. 21, 2016

(65) Prior Publication Data

US 2017/0234090 A1 Aug. 17, 2017

(30) Foreign Application Priority Data

Oct. 14, 2014 (GB) ..... 1418128.3

(51) Int. Cl.
*E21B 23/01* (2006.01)
*E21B 23/04* (2006.01)

(52) U.S. Cl.
CPC ..... *E21B 23/01* (2013.01); *E21B 23/04* (2013.01)

(58) Field of Classification Search
CPC ..... E21B 23/01; E21B 23/04
See application file for complete search history.

(56) References Cited

U.S. PATENT DOCUMENTS 2,878,877 A 3/1959 Baker
3,077,933 A * 2/1963 Bigelow ..... E21B 40/00 166/217
3,279,544 A * 10/1966 Tausch ..... E21B 33/1291 166/216
3,391,742 A * 7/1968 Davis ..... E21B 33/1292 166/139

(Continued)

FOREIGN PATENT DOCUMENTS

GB 2246585 A 2/1992
GB 2411674 A 9/2005
WO 2006/092545 A1 9/2006

OTHER PUBLICATIONS

Int'l Search Report and Written Opinion in counterpart PCT Appl. PCT/GB2015/053025, dated May 6, 2016, 18-pgs.

*Primary Examiner* — Steven A MacDonald
(74) *Attorney, Agent, or Firm* — Blank Rome LLP

(57) ABSTRACT

An anchoring apparatus (110) for use in a wellbore, comprises at least one movable wall engaging member (120) for engaging a wall of a wellbore, wherein the at least one movable wall engaging member (120) is movable from a retracted position to an expanded position to engage the wall, and from the expanded position to a retracted position to disengage the wall. Provision of one or more wall engaging members (120) being movable from an expanded position to a retracted position allows the anchoring apparatus to be retrieved from the wellbore, and in particular, from an open hole.

18 Claims, 6 Drawing Sheets

(56) References Cited

U.S. PATENT DOCUMENTS

| | | | | | |
|---|---|---|---|---|---|
| 3,412,801 | A * | 11/1968 | Young | E21B 33/12955 | 166/120 |
| 3,664,417 | A * | 5/1972 | Conrad | E21B 23/01 | 166/216 |
| 4,131,160 | A * | 12/1978 | Cochran | E21B 23/06 | 166/120 |
| 4,336,841 | A * | 6/1982 | Garner, Jr. | E21B 23/01 | 166/139 |
| 4,375,240 | A * | 3/1983 | Baugh | E21B 33/1295 | 166/120 |
| 4,605,063 | A * | 8/1986 | Ross | E21B 23/01 | 166/216 |
| 4,750,559 | A * | 6/1988 | Greenlee | E21B 23/01 | 166/216 |
| 5,103,902 | A | 4/1992 | Ross et al. | | |
| 5,154,231 | A * | 10/1992 | Bailey | E21B 7/061 | 166/117.6 |
| 5,348,090 | A | 9/1994 | Leismer | | |
| 5,487,427 | A * | 1/1996 | Curington | E21B 23/01 | 166/217 |
| 5,526,884 | A * | 6/1996 | Lembcke | E21B 23/01 | 166/117.6 |
| 5,829,531 | A | 11/1998 | Hebert et al. | | |
| 10,450,816 | B2 * | 10/2019 | Bringham | E21B 23/01 | |
| 2005/0224233 | A1 * | 10/2005 | Johnson | E21B 23/01 | 166/382 |
| 2012/0298378 | A1 * | 11/2012 | McCauley | E21B 23/01 | 166/382 |
| 2013/0299160 | A1 * | 11/2013 | Lott | E21B 23/01 | 166/88.2 |
| 2015/0292284 | A1 * | 10/2015 | Lemm | E21B 33/1291 | 166/216 |

* cited by examiner

DOWNHOLE ANCHOR

FIELD OF THE INVENTION

The present invention relates to well bore anchors and particularly but not exclusively to anchors for use in an open hole.

BACKGROUND TO THE INVENTION

When a well bore is drilled, it is sometimes necessary to provide an anchor in the bore to permit various downhole operations to be performed. An anchor may be required in a cased or lined well bore, or in an "open hole". The term "open hole" refers to an unlined or uncased well bore, i.e. a well bore wherein the exposed wall or surface of the well bore is made up by the formation or rock face.

Rock anchors for use in open holes, and in cased or lined well bores, are known in the art.

Known open hole anchors rely on a combination of engaging elements for penetrating the formation surface and engaging elements for frictionally interacting with the formation surface. Such an arrangement is disclosed in International Patent Application Publication No. WO 2006092545 (MACLEOD et al.), which is incorporated here by reference.

A problem with existing rock anchors is that such anchors are typically not retrievable, i.e. prior art anchors are designed to be permanently anchored into position.

Another problem with existing rock anchors, particular when for use in open holes, is that the debris generated and accumulated near or around the anchoring members during use of the anchor can cause damage to, or adversely affect operation of, various parts of the anchor and/or surrounding downhole equipment.

SUMMARY OF THE INVENTION

According to a first aspect of the present invention there is provided an anchoring apparatus for use in a wellbore, the anchoring apparatus comprising:

at least one movable wall engaging member for engaging a wall of a wellbore, wherein the at least one movable wall engaging member is movable from a retracted position to an expanded position to engage the wall, and from the expanded position to a retracted position to disengage the wall.

The at least one movable wall engaging member may be movable relative to a body, housing or mandrel of the anchoring apparatus.

The at least one movable wall engaging member may be movable from a first retracted position to an expanded position to engage the wall.

The at least one movable wall engaging member may be movable from the expanded position to a second retracted position to disengage the wall.

The first and second retracted positions may be the same or different.

The wall may comprise a consolidated surface, casing, liner, cemented surface, or the like.

Provision of a wall engaging member being movable from an expanded position to a retracted position may allow the anchoring apparatus to be retrieved from the open wellbore.

The at least one movable wall engaging member may be controllably movable from the expanded position to a retracted position, e.g. the second retracted position.

The anchoring apparatus may be an open hole anchor.

The wellbore may comprise an open hole.

The wall may comprise a formation surface, rock face, or the like.

The anchoring apparatus may be configured for bearing or supporting a load. In one embodiment, the anchoring apparatus may be configured for bearing or supporting a load from above, e.g. a deviating and/or deflecting tool, such as a whipstock. In another embodiment, the anchoring apparatus may be configured for bearing or supporting a load from below, e.g. a hanging load. The anchoring apparatus may typically be capable of bearing a load in the region of 100,000 lbs (45,359 kg)-600,000 lbs (272,155 kg), e.g. 200,000 lbs (90,718 kg)-500,000 lbs (226,796 kg).

The anchoring apparatus may comprise a plurality of wall engaging members, for example 2-6, typically three, engaging members.

The wall engaging members may be circumferentially arranged relative to the anchoring apparatus and/or well bore, e.g. equi-spaced around the anchoring apparatus. By such provision, the anchoring load against the wall may be distributed, e.g. substantially evenly distributed, amongst the wall engaging members. The anchoring apparatus may also be suitable for anchoring in well bores, e.g. open holes, that are out-of-round. Out-of-round holes, or holes of non-circular cross-section, can occur during drilling through rock.

The anchoring apparatus may comprise a plurality of movable wall engaging members, e.g. each of the wall engaging members may be a movable wall engaging member. By such provision, deployment of the movable wall engaging members from a retracted position to an expanded position may allow the anchoring apparatus to be substantially centred relative to the wellbore and/or may be substantially aligned with a longitudinal axis of the wellbore.

The anchoring apparatus may be substantially self-centering, e.g. relative to the wellbore, e.g. to a longitudinal axis thereof.

The anchoring apparatus may comprise at least one stationary wall engaging member.

At least one stationary wall engaging member may be stationary relative to a body, housing or mandrel of the anchoring apparatus, i.e. may not be movable between a retracted position and an expanded position. In such instance, anchoring of the anchoring apparatus in the wellbore may be permitted by deployment of the at least one movable wall engaging member from a retracted position to an expanded position. Upon engagement of the at least one movable wall engaging member with the wall, the anchoring apparatus may be radially displaced relative to a longitudinal axis of the wellbore until engagement of the at least one stationary wall engaging member with the wall. By such arrangement, the number of moving parts resulting from the presence of at least one movable wall engaging member may be reduced, thus potentially minimising the risk of failure.

In one embodiment, the wall engaging members may comprise one movable wall engaging member, and two stationary wall engaging members. In an alternative embodiment, the wall engaging members may comprise two movable wall engaging members, and one stationary wall engaging member. In an alternative embodiment, the wall engaging members may comprise two movable wall engaging members, and two stationary wall engaging members, each movable wall engaging member being diametrically opposite a respective stationary wall engaging member. Other configurations may be envisaged, so long as deployment of the at least one movable wall engaging member from a retracted position to an expanded position causes radial displacement of the anchoring apparatus until at least one stationary wall engaging member engages the wall on an opposite side of the anchoring apparatus.

At least one movable wall engaging member may comprise a slip.

Slips are widely used on conventional anchors for cased or lined bores. By providing the present invention in the form of a slip, a conventional, mandrel set, cased or lined bore anchor housing can be used to actuate and anchor the slips to the bore wall, e.g. the formation surface.

At least one movable wall engaging member may define a wedge profile.

At least one movable wall engaging member may comprise an upper angled or tapered surface at or near an upper end thereof. The upper angled or tapered surface may extend from an inner portion thereof to an outer portion thereof. The term "upper end" will be herein understood as referring to an end nearest an entry point of the wellbore.

At least one movable wall engaging member may comprise a lower angled or tapered surface at or near a lower end thereof. The lower angled or tapered surface may extend from an inner portion thereof to an outer portion thereof. The term "lower end" will be herein understood as referring to an end farthest from an entry point of the wellbore and/or nearest a drilling end thereof.

The anchoring apparatus may comprise a housing.

At least one movable wall engaging member may be secured to the housing, e.g. to a mandrel thereof. At least one movable wall engaging member may be radially movable relative to the housing and/or mandrel.

The anchoring apparatus may comprise at least one actuating member for moving at least one movable wall engaging member from a retracted position to an expanded position.

At least one actuating member may comprise a cam structure. The cam structure may be configured for engaging an/the upper angled or tapered surface of at least one movable wall engaging member.

The cam structure may comprise a linear cam structure, e.g. a linear ramp and/or cam.

The cam structure may comprise a rotary cam structure, e.g. a rotary ramp and/or cam.

At least one actuating member may define a ramp, e.g. a substantially linear ramp. The actuating member, cam and/or ramp may comprise an angled portion at or near a lower end thereof. The angled portion may extend from an outer portion to an inner portion thereof.

The at least one actuating member may be configured to move longitudinally towards at least one movable wall engaging member. Each actuating member may be movable towards a respective movable wall engaging member.

In use, movement of the at least one actuating member towards a movable wall engaging member may cause the angled portion of the actuating member to engage the upper angled or tapered surface of the movable wall engaging member, thus forcing the movable wall engaging member radially outwards towards the formation.

At least one actuating member may be movable by hydraulic actuation, e.g. by use of a hydraulic fluid.

Hydraulic actuation may comprise using hydrostatic pressure. The hydraulic fluid may comprise a hydrostatic fluid. This may be advantageous when drilling in environments exhibiting high hydrostatic pressures, e.g. at relatively high depths.

Hydraulic actuation may comprise using hydraulic pressure provided and/or controlled from surface. The hydraulic fluid may comprise a hydraulic fluid fed and/or delivered from surface. The hydraulic fluid may comprise a hydraulic fluid fed and/or delivered from surface to a downhole location.

In one embodiment, the hydraulic fluid may comprise a hydraulic fluid fed and/or delivered to the anchor, e.g. by use of a conduit between a source of hydraulic fluid and the anchor.

In another embodiment, the hydraulic fluid may comprise a hydraulic fluid fed and/or delivered to a location remote from the anchor. The hydraulic fluid may comprise a hydraulic fluid fed and/or delivered to a tool associated with and/or in fluid communication with the anchor. The hydraulic fluid may comprise a hydraulic fluid fed and/or delivered to a bottom hole assembly (BHA), for example at or near a drilling end thereof. Hydraulic pressure may be delivered to a drilling end of the BHA through a bore of the BHA and/or drill string. The BHA and/or drill string bore may comprise a fluid flow control device, e.g. an orifice, which may create and/or generate a back pressure of hydraulic fluid in the bore. Hydraulic fluid associated with and/or created by such back pressure may be fed and/or delivered to the anchor, e.g. through a conduit which may extend from the bore to the anchor. This may permit accurate control of the hydraulic pressure delivered to actuate at least one actuating member.

The anchoring apparatus, e.g. the housing, may comprise at least one lower sleeve configured for contacting at least one movable wall engaging member at or near an upper end of the at least one lower sleeve.

At least one lower sleeve may comprise a cam structure. The cam structure may be configured for engaging an/the lower angled or tapered surface of at least one movable wall engaging member.

At least one lower sleeve may define a linear ramp and/or cam, e.g. a substantially linear ramp.

At least one lower sleeve may define a rotary ramp and/or cam.

At least one lower sleeve, cam and/or ramp may comprise an angled portion at or near an upper end thereof. The angled portion may extend from an outer portion to an inner portion thereof.

At least one lower sleeve may be fixed and/or attached relative to the housing and/or mandrel, at least before and/or during deployment of the at least one movable wall engaging member and/or after deployment while the at least one movable formation is in an expanded position.

In use, movement and/or engagement of at least one actuating member towards/with a movable wall engaging member may cause, e.g. by reaction, the movable wall engaging member to engage at least one lower sleeve. Movement and/or engagement of at least one actuating member towards/with a movable wall engaging member may cause the lower angled or tapered surface of the movable wall engaging member to engage the upper angled portion of at least one lower sleeve, e.g. a respective lower sleeve, thus forcing the movable wall engaging member radially outwards towards the formation. In other words, movement of the at least one actuating member towards a movable wall engaging member may cause the movable wall engaging member to be wedged radially outwards towards the bore wall.

The anchoring apparatus may comprise a mandrel. The mandrel may define an inner portion or inner surface of the anchoring apparatus.

The at least one movable wall engaging member may be configured for moving on/relative to an outer portion and/or outer surface of the mandrel.

The anchoring apparatus may comprise at least one outer sleeve.

The at least one outer sleeve may be located on an upper side relative to the movable wall engaging member.

The at least one outer sleeve may be fixedly attached to and/or may be stationary relative to the mandrel.

The mandrel and at least one outer sleeve may define an annular space in which a respective actuating member may be capable of moving, e.g. longitudinally.

In use, movement of the actuating member may be controlled and/or permitted by application of an actuating force, e.g. pressure, such as a hydraulic fluid.

The anchoring apparatus may comprise a fluid inlet configured to allow feeding of a fluid, e.g. hydraulic fluid, into the annular space. In use, feeding of a hydraulic fluid into the annular space may force at least one actuating member towards at least one movable wall engaging member, e.g. towards a respective movable wall engaging member.

The anchoring apparatus may comprise a unidirectional or "non return" mechanism adapted to allow at least one actuating member to move, e.g. slide, towards a respective movable wall engaging member, but prevent movement of the actuating member in an opposite direction. By such provision, the at least one actuating member may be prevented from moving or sliding away from a respective movable wall engaging member, even in the event of a loss of hydraulic pressure. This, in turn, may prevent the movable wall engaging member to accidentally retract into a retracting position, thus maintaining the anchoring apparatus in an engaged position in the open hole.

The unidirectional or "non return" mechanism may comprise a ratchet mechanism, latch, wicker thread, and the like.

In the (first) retracted or non-deployed (pre-anchoring) configuration, the actuating member may be attached, e.g. detachably attached, to at least one outer sleeve. The actuating member may be attached to at least one outer sleeve via a connector. The connector may engage at least one outer sleeve, e.g. via complementary mating features. The provision of a connector may ensure that, in a retracted (pre-anchoring) configuration, the anchoring apparatus can be deployed to a desired location in a wellbore while reducing or avoiding the risk of activating the actuating member, thus avoiding accidental deployment of a respective movable wall engaging member. In use, the actuating member may be detachable from at least one outer sleeve and/or the connector may be caused to disengage at least one outer sleeve, by application of a load, e.g. hydraulic pressure, on the actuation member.

At least one lower sleeve may be detachably connected to the mandrel. At least one lower sleeve may be attached and/or connected to the mandrel by a releasable connection, e.g. a frangible connection. The releasable and/or frangible connection may comprise a shear pin, latch, or the like.

The releasable connection may be configured to connect at least one lower sleeve to the mandrel before and/or during deployment of the at least one movable wall engaging member and/or after deployment while the at least one movable formation is in an expanded position.

The releasable connection may be configured to disconnect, e.g. shear, by application of a predetermined force. In one embodiment, the releasable connection may be configured to disconnect, e.g. shear, by application of a pulling force on the mandrel. The pulling force may be above a predetermined value, which may depend upon the type of application envisaged for the anchoring apparatus. Typically, the pulling force required to disconnect, e.g. shear, the releasable connection may be in the range of about 10,000 lbs (4,536 kg) to about 100,000 lbs (45,359 kg), e.g. about 20,000 lbs (9,072 kg) to about 70,000 lbs (31,751 kg), e.g. about 50 000 lbs (22,680 kg).

In use, upon disconnection of the releasable connection, at least one lower sleeve may be capable of moving and/or sliding, e.g. longitudinally, away from a respective movable wall engaging member. At least one lower sleeve may be capable of moving away from a respective wall engaging member due the reactive load from the actuating member on the at least one lower sleeve. At least one lower sleeve may be capable of moving away from a respective wall engaging member under its own weight, e.g. when used in a vertical and/or angled wellbore. At least one lower sleeve may be capable of moving away from a respective wall engaging member by application of a force, such as application of fluid pressure by feeding a hydraulic fluid. The hydraulic fluid may be fed in an annular chamber between at least one lower sleeve and the mandrel.

As at least one lower sleeve is disconnected from the mandrel, application of a pulling force on the mandrel may cause upwards movement of the mandrel and thus of a respective actuating member, but not of the lower sleeve. This may increase a distance between the at least one lower sleeve and a respective actuating member, which may in turn allow the movable wall engaging member to disengage the bore wall.

The mandrel may be provided with or may comprise one or more openings.

The one or more openings may be adjacent to and/or may be facing one or more wall engaging members.

At least one opening may provide an opening from an inner portion or surface of the mandrel, e.g. an inner bore, to an outer portion or surface of the mandrel, e.g. a portion or surface of the mandrel facing an inner side of at least one wall engaging member. By such provision, any debris generated and accumulated on an inner side or behind a wall engaging member during use of the anchor, e.g. due to friction and/or pressure of the movable wall engaging member(s) against the rock formation, may be evacuated and discarded into the wellbore. This may help prevent accidental damage or malfunction of various parts of the anchoring apparatus and/or surrounding downhole equipment. Because the mandrel may not bear significant axial load, the provision of openings in the mandrel may not adversely affect the structural integrity and/or strength of the mandrel.

The opening(s) of the mandrel may extend substantially longitudinally, transversely, or in any other suitable pattern, relative to the anchoring apparatus and/or wellbore.

The opening(s) of the mandrel may be similar in size or larger than the at least one wall engaging member. This may improve evacuation of debris into the wellbore, e.g. from an inner side or behind a wall engaging member into the wellbore.

At least one wall engaging member may be provided with or may comprise one or more openings. By such provision, any debris generated and accumulated near or around the wall engaging members during use of the anchor, e.g. due to friction and/or pressure of the wall engaging member(s) against the bore wall, e.g. rock formation, may be evacuated away from the formation surface. This may help prevent accidental damage or malfunction of various parts of the anchoring apparatus and/or surrounding downhole equipment.

The opening(s) of the wall engaging member(s) may extend substantially longitudinally, transversely, or in any other suitable pattern, relative to the anchoring apparatus and/or wellbore.

At least one movable wall engaging member may be provided with or may comprise one or more openings. Provision of one or more openings on at least one movable wall engaging member, e.g. each movable wall engaging member, may allow evacuation of debris generated and accumulated near or around the movable wall anchoring members. This may allow at least one movable wall engaging member to be moved into a retracted position when the anchoring apparatus is to be disengaged from the bore wall, without the debris accumulating and thus preventing retraction of the movable wall engaging member.

The opening(s) of the at least one wall engaging member may be substantially aligned with the opening(s) of the mandrel. By such provision, evacuation of debris may be optimised.

The opening(s) of the mandrel may be similar in size or larger than the opening(s) of the at least one wall engaging member. This may further improve evacuation of debris into the wellbore.

At least one wall engaging member may comprise a plurality of engaging elements for engaging, e.g. contacting, penetrating, and/or piercing, a surface of the formation.

The engaging elements may be arranged in parallel rows.

The engaging elements and/or parallel rows may be arranged transversely, e.g. substantially perpendicularly, obliquely, or in a zigzag arrangement, relative to a longitudinal axis of the wall engaging member, anchoring apparatus, and/or bore hole.

The arrangement of the engaging elements may be positioned based on the wall surface to be engaged, e.g. to match, complement, or optimise engagement with, the wall structure, e.g. rock structure of a formation.

The engaging elements may comprise rows of teeth.

The engaging elements may comprise conventional engaging elements or teeth.

The engaging elements may comprise at least one first wall surface engaging element for penetrating a surface of a bore hole, e.g. open hole, and at least one second wall surface engaging element for frictionally interacting with a surface of the bore wall, e.g. open hole, to form an interference engagement with the wall surface. Such engaging elements are disclosed in International Patent Application Publication No. WO 2006092545 (MACLEOD et al.), which is incorporated here by reference. The provision of a combination of first and second engaging elements, the first of which penetrates the wall surface and second of which forms an interference with the wall surface allows, when in use with an anchoring apparatus, the wall engaging member to anchor the apparatus to the wall surface, e.g. formation surface of an open hole, without overstressing the bore wall, e.g. formation, which could cause the rock to fracture.

The engaging elements may comprise at least one first engaging element or tooth/teeth arranged to at least partially penetrate or bite into the wall, e.g. formation. The first engaging element(s) or teeth may be configured to maximise the pressure applied to the wall, e.g. formation, as the force is channelled through a relatively small contact area, enabling the first engaging element(s) or teeth to penetrate the formation.

The engaging elements may comprise at least one second engaging element or pad arranged to contact the wall surface, e.g. formation surface. The second engaging element(s) or pad(s) may have an increased contact area through which the anchoring force can be channelled, resulting in a lower pressure being applied to the bore wall, e.g. formation, thereby ensuring the bore wall, e.g. formation is gripped or pressed against, rather than pierced or penetrated.

The second engaging element(s) or pad(s) may comprise an abrasive surface or any surface suitable for providing a localised increase in friction when engaged with a bore wall, e.g. formation. The provision of second engaging element(s) or pad(s) may also reduce or minimise the amount of debris generated by the wall engaging member, in use.

The abrasive surface may comprise a knurled surface.

The engaging elements may extend outwardly from a surface of the wall engaging member.

The at least one first engaging element or teeth may extend outwardly beyond the at least one second engaging element or pad.

At least one wall engaging member and/or engaging element may comprise metal. At least one wall engaging member may comprise mild steel. At least one wall engaging member and/or engaging element may comprise tungsten carbide. Alternatively, any suitable material such as a composite may be used for the at least one wall engaging member and/or engaging element.

Metal is a particularly suitable material for the wall engaging members because it lends itself to machining. Up to three wall engaging members can be machined from a suitably dimensioned section of metal tubing. The metal chosen will depend on the surface to be anchored to. When used in an open hole, the metal chosen may be selected to be harder than the formation. For example, for a sandstone formation, a mild steel expandable member may be suitable. For a hard rock formation, e.g. granite, a tungsten carbide expandable member may be suitable. When used in a cased or lined bore, the metal chosen may be selected to minimise damage to the casing or lining.

At least one wall engaging member may comprise at least one insert comprising a plurality of engaging elements. At least one wall engaging member and at least one insert may comprise the same material, or may comprise different materials. In one embodiment, at least one wall engaging member may comprise metal such as mild steel. At least one insert may comprise a metal such as mild steel or tungsten carbide. By such provision, inserts of adequate hardness may be provided on the wall engaging members based on the intended use, e.g. the nature of a particular bore wall. At least one insert may be replaceable, e.g. upon wear of the plurality of engaging elements thereof, or upon use in a different bore wall.

According to a second aspect of the present invention there is provided an anchoring apparatus for use in a wellbore, the anchoring apparatus comprising a mandrel, wherein the mandrel is provided with one or more openings providing communication with the wellbore.

The anchoring apparatus may comprise at least one wall engaging member for engaging a wall of a wellbore.

At least one wall engaging member may be attached or connected to the mandrel.

The one or more openings of the mandrel may be adjacent to and/or may be facing one or more wall engaging members.

At least one opening may provide an opening from an inner portion or surface of the mandrel, e.g. an inner bore, to an outer portion or surface of the mandrel, e.g. a portion or surface of the mandrel facing an inner side of at least one wall engaging member. By such provision, any debris generated and accumulated on an inner side or behind a wall engaging member during use of the anchor, e.g. due to friction and/or pressure of the movable wall engaging member(s) against the rock formation, may be evacuated and discarded into the wellbore. This may help prevent accidental damage or malfunction of various parts of the anchoring apparatus and/or surrounding downhole equipment. Because the mandrel may not bear significant axial load, the provision of openings in the mandrel may not adversely affect the structural integrity and/or strength of the mandrel.

The opening(s) of the mandrel may extend substantially longitudinally, transversely, or in any other suitable pattern, relative to the anchoring apparatus and/or wellbore.

The opening(s) of the mandrel may be similar in size or larger than the at least one wall engaging member. This may improve evacuation of debris into the wellbore, e.g. from an inner side or behind a wall engaging member into the wellbore.

At least one wall engaging member may be provided with or may comprise one or more openings. By such provision, any debris generated and accumulated near or around the wall engaging members during use of the anchor, e.g. due to friction and/or pressure of the wall engaging member(s) against the bore wall, e.g. rock formation, may be evacuated away from the formation surface. This may help prevent accidental damage or malfunction of various parts of the anchoring apparatus and/or surrounding downhole equipment.

The opening(s) of the wall engaging member(s) may extend substantially longitudinally, transversely, or in any other suitable pattern, relative to the anchoring apparatus and/or wellbore.

At least one wall engaging member may comprise at least one movable wall engaging member for engaging a wall of a wellbore. At least one movable wall engaging member may be movable from a retracted position to an expanded position to engage the wall, and from the expanded position to a retracted position to disengage the wall. At least one movable wall engaging member may be configured for moving on/relative to an outer portion and/or outer surface of the mandrel.

At least one movable wall engaging member may be provided with or may comprise one or more openings. Provision of one or more openings on at least one movable wall engaging member, e.g. each movable wall engaging member, may allow evacuation of debris generated and accumulated near or around the movable wall anchoring members. This may allow at least one movable wall engaging member to be moved into a retracted position when the anchoring apparatus is to be disengaged from the bore wall, without the debris accumulating and thus preventing retraction of the movable wall engaging member.

The opening(s) of the at least one wall engaging member may be substantially aligned with the opening(s) of the mandrel. By such provision, evacuation of debris may be optimised.

The opening(s) of the mandrel may be similar in size or larger than the opening(s) of the at least one wall engaging member. This may further improve evacuation of debris into the wellbore.

The bore wall may comprise a consolidated surface, casing, liner, cemented surface, or the like.

The bore wall may comprise a formation, e.g. a rock formation. The anchoring apparatus may be an open hole anchor.

The features described above in relation to the apparatus according to a first aspect or the invention, can apply in respect of the apparatus according to a second aspect of the present invention, and are therefore not repeated here for brevity.

According to a third aspect of the present invention there is provided a method for disengaging an anchoring apparatus from a wall of a wellbore, the method comprising:

moving at least one movable wall engaging member from an engaging position wherein the at least one movable wall engaging member engages the wall, to a retracted position wherein the at least one movable wall engaging member disengages the wall.

The method may comprise providing the apparatus in a wellbore, e.g. an open hole.

The method may comprise anchoring the apparatus to the wall of a wellbore.

The method may comprise moving at least one movable wall engaging member in engagement with the wall.

The method may comprise actuating at least one actuating member configured for moving at least one movable wall engaging member from a retracted position to an expanded position.

The method may comprise hydraulically actuating at least one actuating member.

Hydraulic actuation may comprise using hydrostatic pressure. The method may comprise using a hydrostatic fluid to actuate at least one actuating member. This may be advantageous when drilling in environments exhibiting high hydrostatic pressures, e.g. at relatively high depths.

Hydraulic actuation may comprise using hydraulic pressure provided and/or controlled from surface. The method may comprise using a hydraulic fluid fed and/or delivered from surface to a downhole location to actuate at least one actuating member.

In one embodiment, the hydraulic actuation may comprise feeding and/or delivering a hydraulic fluid to the anchor, e.g. by use of a conduit between a source of hydraulic fluid and the anchor.

In another embodiment, hydraulic actuation may comprise feeding and/or delivering a hydraulic fluid to a location remote from the anchor. Hydraulic actuation may comprise feeding and/or delivering a hydraulic fluid to a tool associated with and/or in fluid communication with the anchor. Hydraulic actuation may comprise feeding and/or delivering a hydraulic fluid to a bottom hole assembly (BHA), for example at or near a drilling end thereof. Hydraulic pressure may be delivered to a drilling end of the BHA through a fluid conduit. The fluid conduit and/or BHA may comprise a fluid flow control device, e.g. an orifice, which may create and/or generate a back pressure of hydraulic fluid in the BHA conduit. Hydraulic fluid associated with and/or created by such back pressure may be fed and/or delivered to the anchor, e.g. through a conduit which may extend from the BHA fluid conduit and the anchor. This may permit accurate control of the hydraulic pressure delivered to actuate at least one actuating member.

The step of moving at least one movable wall engaging member from an engaging position to a retracted position may comprise releasing at least one lower sleeve configured for contacting at least one movable wall engaging member at or near an upper end of the at least one lower sleeve.

The method may comprise releasing at least one lower sleeve detachably connected relative to a mandrel of the anchoring apparatus.

At least one lower sleeve may be attached and/or connected to the mandrel by a releasable connection, e.g. a frangible connection. The releasable and/or frangible connection may comprise a shear pin, latch, or the like. The method may comprise releasing disconnecting the least one lower sleeve from the mandrel, e.g. by disconnecting and/or breaking the releasable and/or frangible connection.

The features described above in relation to the apparatus according to a first or second aspect or the invention, can apply in respect of the method according to a third aspect of the present invention, and are therefore not repeated here for brevity.

According to a fourth aspect of the present invention there is provided a method for providing an anchor in a wellbore, the anchor comprising a mandrel, wherein the mandrel is provided with one or more openings providing communication with the wellbore.

The anchor may comprise at least one wall engaging member for engaging a wall of a wellbore.

At least one wall engaging member may be attached or connected to the mandrel.

The one or more openings of the mandrel may be adjacent to and/or may be facing one or more wall engaging members.

At least one opening may provide an opening from an inner portion or surface of the mandrel, e.g. an inner bore, to an outer portion or surface of the mandrel, e.g. a portion or surface of the mandrel facing an inner side of at least one wall engaging member. By such provision, any debris generated and accumulated on an inner side or behind a wall engaging member during use of the anchor, e.g. due to friction and/or pressure of the movable wall engaging member(s) against the rock formation, may be evacuated and discarded into the wellbore. This may help prevent accidental damage or malfunction of various parts of the anchoring apparatus and/or surrounding downhole equipment. Because the mandrel may not bear significant axial load, the provision of openings in the mandrel may not adversely affect the structural integrity and/or strength of the mandrel.

The opening(s) of the mandrel may extend substantially longitudinally, transversely, or in any other suitable pattern, relative to the anchoring apparatus and/or wellbore.

The opening(s) of the mandrel may be similar in size or larger than the at least one wall engaging member. This may improve evacuation of debris into the wellbore, e.g. from an inner side or behind a wall engaging member into the wellbore.

At least one wall engaging member may be provided with or may comprise one or more openings. By such provision, any debris generated and accumulated near or around the wall engaging members during use of the anchor, e.g. due to friction and/or pressure of the wall engaging member(s) against the bore wall, e.g. rock formation, may be evacuated away from the formation surface. This may help prevent accidental damage or malfunction of various parts of the anchoring apparatus and/or surrounding downhole equipment.

The opening(s) of the wall engaging member(s) may extend substantially longitudinally, transversely, or in any other suitable pattern, relative to the anchoring apparatus and/or wellbore.

At least one wall engaging member may comprise at least one movable wall engaging member for engaging a wall of a wellbore. At least one movable wall engaging member may be movable from a retracted position to an expanded position to engage the wall, and from the expanded position to a retracted position to disengage the wall. At least one movable wall engaging member may be configured for moving on/relative to an outer portion and/or outer surface of the mandrel.

At least one movable wall engaging member may be provided with or may comprise one or more openings. Provision of one or more openings on at least one movable wall engaging member, e.g. each movable wall engaging member, may allow evacuation of debris generated and accumulated near or around the movable wall anchoring members. This may allow at least one movable wall engaging member to be moved into a retracted position when the anchoring apparatus is to be disengaged from the bore wall, without the debris accumulating and thus preventing retraction of the movable wall engaging member.

The opening(s) of the at least one wall engaging member may be substantially aligned with the opening(s) of the mandrel. By such provision, evacuation of debris may be optimised.

The opening(s) of the mandrel may be similar in size or larger than the opening(s) of the at least one wall engaging member. This may further improve evacuation of debris into the wellbore.

The method may comprise anchoring the apparatus to the wall.

The method may comprise moving at least one movable wall engaging member from a retracted position wherein the at least one movable wall engaging member disengages the wall, to an engaging position wherein the at least one movable wall engaging member engages the wall.

The anchoring apparatus may comprise a mandrel. The mandrel may define an inner portion or surface of the anchoring apparatus.

The mandrel may be provided with one or more openings. By such provision, any debris generated and accumulated near or around the anchoring members during use of the anchor, e.g. due to friction and/or pressure of the anchoring member(s) against the bore wall, e.g. rock formation, may be evacuated and discarded into the wellbore.

The opening(s) of the at least one wall engaging member may be substantially aligned with the opening(s) of the mandrel. By such provision, evacuation of debris may be optimised.

The opening(s) of the mandrel may be similar in size or larger than the opening(s) of the at least one wall engaging member. This may also improve evacuation of debris into the wellbore.

The method may comprise evacuating debris from the bore wall, e.g. formation, into the wellbore, e.g. through at least one opening.

The features described above in relation to the apparatus according to a first or second aspect or the invention, or the method according to a third aspect of the invention, can apply in respect of the method according to a fourth aspect of the present invention, and are therefore not repeated here for brevity.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
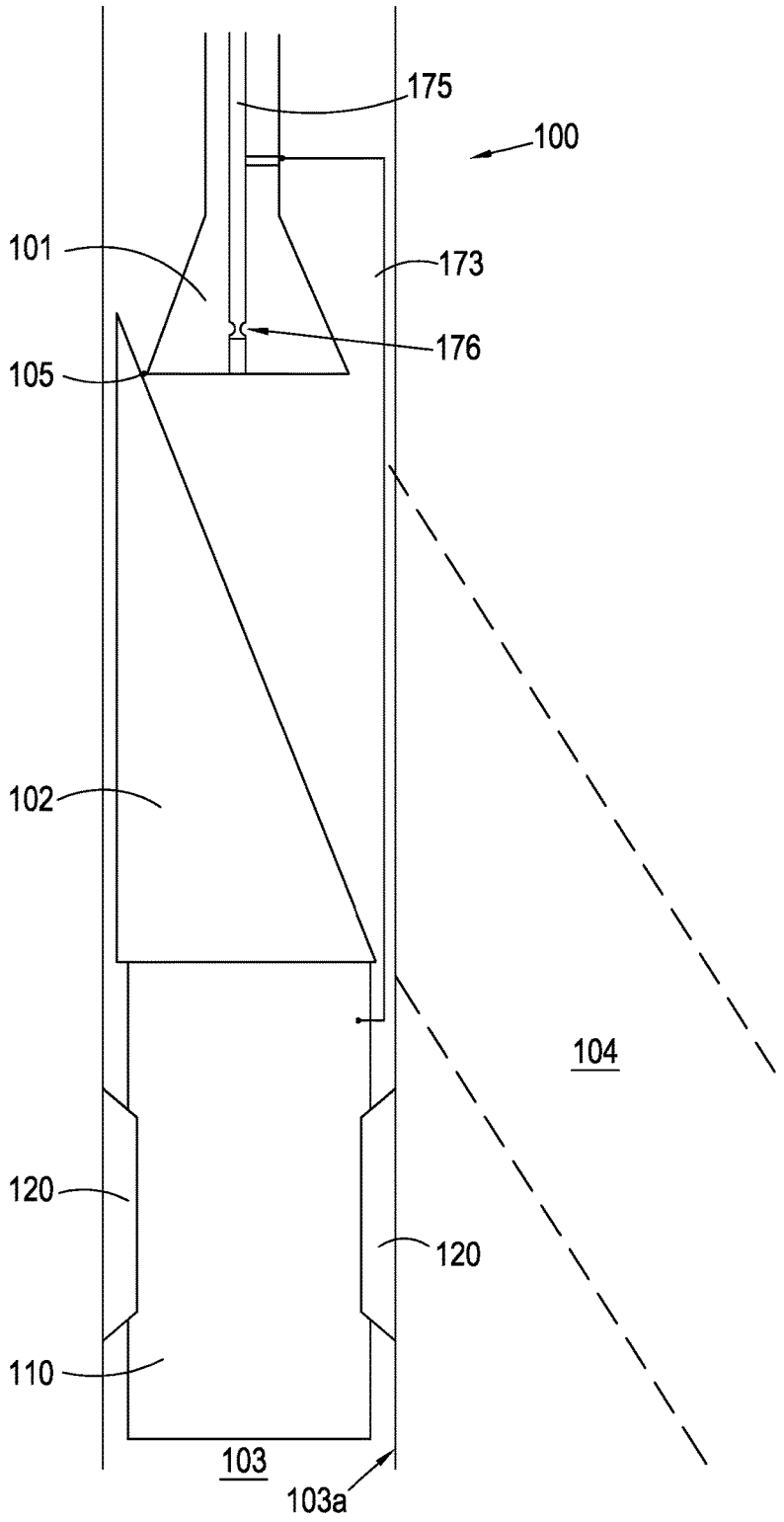
FIG. 1 is a schematic view of a downhole assembly comprising a bottom hole assembly (BHA), a whipstock, and an anchoring apparatus according to an embodiment of the present invention.

FIG. 1 shows a schematic view of downhole assembly, generally designated by reference number 100. The downhole assembly comprises a bottom hole assembly (BHA) 101, a whipstock 102, and an anchoring apparatus 110 according to an embodiment of the present invention.

The downhole assembly is provided in a wellbore 103, which in this embodiment is an open hole 103.

A whipstock 102 is provided inside the primary wellbore 103 in order to deflect BHA 101 to drill a secondary or lateral wellbore 104 from the primary wellbore 103.

The BHA 101 is initially connected to the whipstock 102 by a connection such as a sliding connection 105. The BHA 101 is typically used to run the whipstock 102 and the anchoring apparatus 110 into the wellbore 103.

The whipstock 102 is supported and maintained in position by anchoring apparatus 110. The anchoring apparatus 110 may be provided separate from, and attached to, the whipstock 102. Alternatively, the anchoring apparatus 110 may be integral to the whipstock 102.

The anchoring apparatus 110 comprises a plurality of wall engaging members 120 for engaging a wall 103*a* of wellbore 103. In this embodiment the wall 103*a* consists of an open hole formation.

In this embodiment the wall engaging members 120 are all movable slips 120, which are circumferentially arranged relative to the anchoring apparatus 110. This allows self-centering of the anchoring apparatus 110 relative to the wellbore 103, which may be particularly advantageous if the wellbore 103 is "out-of-round" or non-circular in cross-section.

However, it will be appreciated that in other embodiments the anchoring apparatus 110 may comprise a combination of stationary and movable wall engaging members 120.

The movable slips 120 are movable from a first retracted position in which the movable slips 120 are not engaged with the bore wall 103*a*, to an expanded position in which the movable slips 120 are engaged with the bore wall 103*a*. The movable slips 120 are further movable from the expanded position to a second retracted position in which the movable slips 120 are disengaged or released from the bore wall 103*a*. In this embodiment the first and second retracted positions are not identical, as will be described below in more detail.

Provision of movable slips 120 allows the anchoring apparatus 110 to be retrieved from the wellbore 103 once its function has been performed. This may allow further access to the wellbore 103, for example if further access to the wellbore 103 is required.

As shown in FIGS. 2A to 4C, the anchoring apparatus comprises a mandrel 130. The mandrel 130 defines an inner surface 132 of the anchoring apparatus 110.

The movable slips 120 are connected to and are and radially movable relative to the mandrel 130.

The anchoring apparatus 110 comprises at least one, in this embodiment one, actuating member 140 configured for moving a respective movable slip 120 from a retracted position to an expanded position.

Each movable slip 120 defines a wedge profile.

Each movable slip 120 comprises an upper angled or tapered surface 121 at or near an upper end thereof. The upper angled or tapered surface 121 extends from an inner portion 122 thereof to an outer portion 123 thereof. The term "upper end" will be herein understood as referring to an end nearest an entry point of the wellbore 103.

Each movable slip 120 comprises a lower angled or tapered surface 124 at or near a lower end thereof 125. The lower angled or tapered surface 124 extends from an inner portion 122 thereof to an outer portion 123 thereof. The term "lower end" will be herein understood as referring to an end farthest from an entry point of the wellbore 103.

The anchoring apparatus 110 comprises at least one, in this embodiment a plurality of, outer sleeves 150 located on an upper side of a respective movable slip 120.

Each outer sleeve 150 is fixedly attached to and/or is stationary relative to the mandrel 130.

The mandrel 130 and each outer sleeve 150 define a respective annular space 170 in which the actuating member 140 is capable of moving, e.g. of sliding longitudinally.

The actuation member 140 comprises a cam structure 141 configured for engaging an upper angled or tapered surface 121 of a respective movable slip 120. In this embodiment the cam structure 141 comprises a linear cam structure which defines a substantially linear ramp 141. In alternative embodiments (not shown), the cam structure 141 may comprise a rotary cam structure such as a rotary ramp or cam.

The ramp 141 comprises an angled portion at or near a lower end thereof of the actuation member 140. The angled portion extends from an outer portion 143 to an inner portion 142 thereof.

The anchoring apparatus 110 comprises at least one, and in this embodiment a plurality of, lower sleeves 160 configured for contacting a respective movable slip 120 at or near an upper end of the lower sleeve 160.

Each lower sleeve 160 comprises a cam structure 161 configured for engaging a lower angled or tapered surface 124 of a respective movable slip 120. In this embodiment, the cam structure 161 defines a substantially linear ramp 161. In alternative embodiments (not shown), the cam structure 161 may comprise a rotary cam structure such as a rotary ramp or cam.

The ramp 161 comprises an angled portion 161 at or near an upper end thereof. The angled portion 161 extends from an outer portion 163 to an inner portion 162 thereof.

Figure 2A:
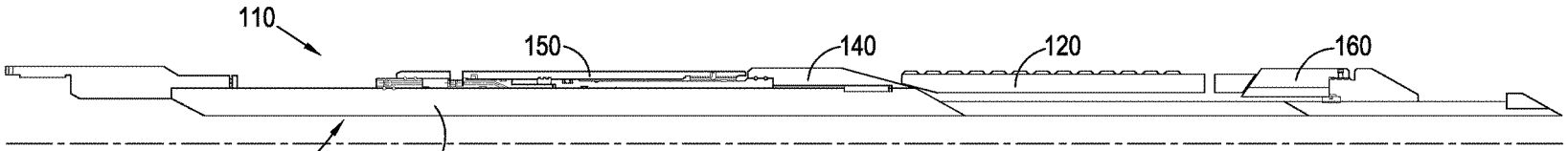
FIG. 2A is a cross-sectional view of the anchoring apparatus of FIG. 1 in a retracted (pre-anchoring) configuration.
Figure 2B:
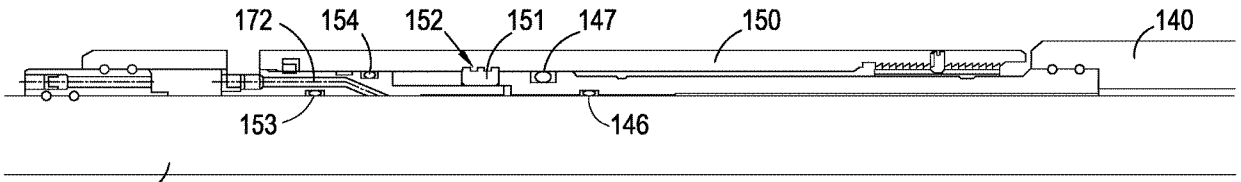
FIG. 2B is an enlarged view of an upper portion of the anchoring apparatus of FIG. 2A.
Figure 2C:
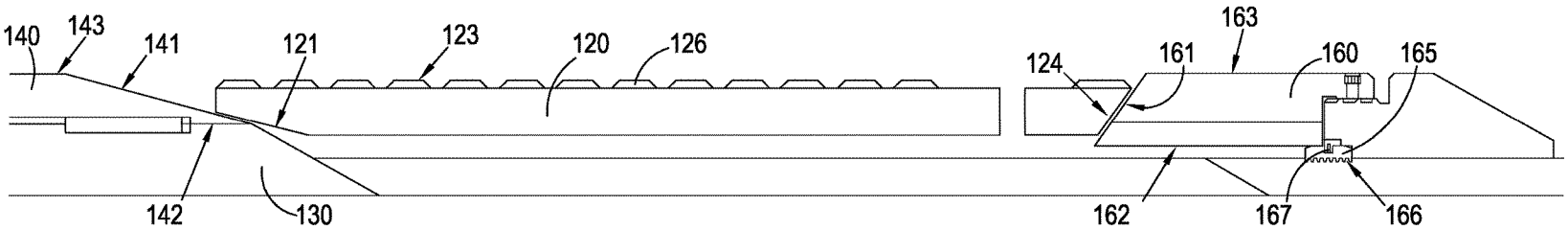
FIG. 2C is an enlarged view of a lower portion of the anchoring apparatus of FIG. 2A.

Referring now to FIGS. 2A, 2B and 2C, there is shown the anchoring apparatus 110 in a retracted (pre-anchoring) configuration.

The outer sleeve 150 is fixedly attached to and/or is stationary relative to the mandrel 130.

In the retracted (pre-anchoring) configuration, the actuating member 140 is attached to the outer sleeve 150 via connector 151. The connector comprises protrusions which engage complementary recesses 152 on an inner surface of the outer sleeve. The connector 151 ensures that, in the retracted (pre-anchoring) configuration, the anchoring apparatus 110 can be deployed to a desired location in a wellbore 103 without any risk of activating the actuating member 140, thus avoiding accidental deployment of the movable slips 120.

In the retracted (pre-anchoring) configuration, the lower sleeve 160 is attached to the mandrel 130 via connector 165. The connector 165 comprises protrusions which engage complementary recesses 166 on an outer surface of the mandrel 130. The lower sleeve 160 is attached to the connector 165 via a shear pin 167. The connector 165 ensures that the lower sleeve remains stationary relative to the mandrel when pressure is applied from above on the lower sleeve 160, e.g. during deployment of the movable slips 120.

As shown in FIGS. 2A, 3A, 4A and 2C, 3C, 4C, the mandrel 130 comprises openings 135 facing movable slip 120. The openings 135 provide an opening from an inner surface 132 of the mandrel 130 to an inner side 122 of movable slip 120. By such provision, any debris generated and accumulated on an inner side or behind movable slip 120 during use of the anchoring apparatus 110, e.g. due to friction and/or pressure of the movable slip 120 against the bore wall 103*a*, can be evacuated and discarded into the wellbore 103. This may help prevent accidental damage or malfunction of various parts of the anchoring apparatus 110 and/or surrounding downhole equipment. Because the mandrel 130 does not bear significant axial load, the provision of openings 135 in the mandrel 130 does not adversely affect the structural integrity and/or strength of the mandrel 130.

The openings 135 of the mandrel 130 extend substantially longitudinally relative to the mandrel 130, anchoring apparatus 110, and wellbore 103.

Figure 3A:
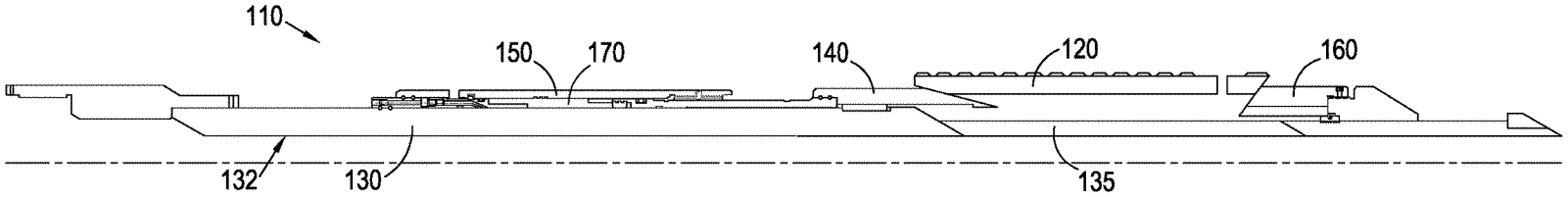
FIG. 3A is a cross-sectional view of the anchoring apparatus of FIG. 1 in an expanded (anchored) configuration.
Figure 3B:
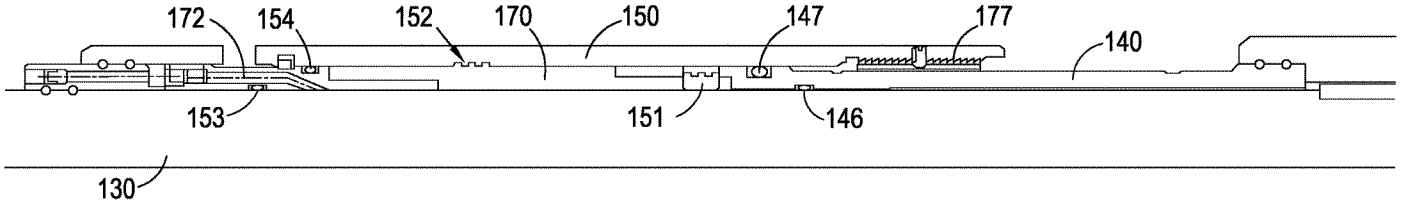
FIG. 3B is an enlarged view of an upper portion of the anchoring apparatus of FIG. 3A.
Figure 3C:
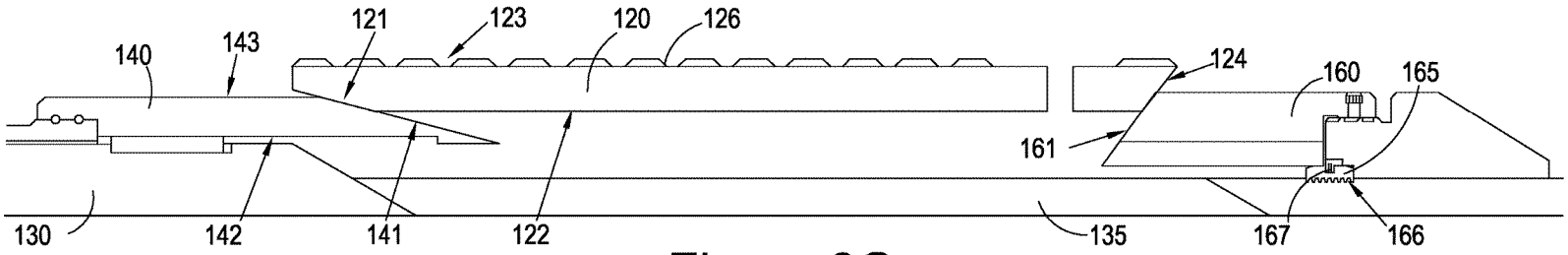
FIG. 3C is an enlarged view of a lower portion of the anchoring apparatus of FIG. 3A.

Referring now to FIGS. 3A, 3B and 3C, there is shown the anchoring apparatus 110 in an expanded (anchored) configuration.

An mentioned above, the mandrel 130 and each outer sleeve 150 define a respective annular space 170 in which the actuating member 140 is capable of moving, e.g. of sliding longitudinally.

A pair of upper seals 153, 154 are provided on an upper side of the annular space 170 between the outer sleeve 150 and the mandrel 130.

A pair of lower seals 146, 147 are provided on lower side of the annular space 170. A first lower seal 146 is provided between the actuating member 140 and the mandrel 130. A second lower seal 147 is provided between the actuating member 140 and the outer sleeve 150.

Deployment of the actuation member 140 is carried out by feeding a hydraulic fluid though fluid inlet 172. In this embodiment, the hydraulic fluid is provided by a hydraulic fluid line 173 associated with a drill string of a bottom hole assembly (BHA) 101. Hydraulic fluid is delivered to a drill string of the BHA 101 through a bore 175. The bore 175 comprises a fluid flow control device 176 which creates and/or generates a back pressure of hydraulic fluid in the bore 175. High pressure hydraulic fluid is thus fed to hydraulic fluid line 173.

In alternative embodiments, the hydraulic fluid may be provided using hydrostatic pressure, e.g. may be hydrostatic fluid, or may be a hydraulic fluid provided from surface using a separate hydraulic fluid line.

When a hydraulic fluid is fed via fluid inlet 172 into the annular space 170, hydraulic pressure causes the connector 151 to disengage from the outer sleeve 150, thus releasing the actuating member 140. The skilled person will appreciate that different types of connectors 151 may be selected depending on the application required for the anchoring apparatus 110, and on the desired force required to disengage the connector 151 from the outer sleeve 150. The connector may be selected to disengage the outer sleeve upon application of a predetermined force or load. Typically, the force required to disengage the connector 151 from the outer sleeve 150 may be in the range of about 500 lbs (227 kg) to about 2000 lbs (907 kg), e.g. about 1000 lbs (454 kg). In one embodiment, the connector may be adjustable, e.g. the force required to disengage the connector 151 from the outer sleeve 150 may be adjusted. This may allow a user to adjust the load required to disengage the connector 151 from the outer sleeve 150, e.g. prior to deployment of the anchoring apparatus 110 in in a wellbore 103.

Injection of further hydraulic fluid forced the actuating member 140 to move downwardly and longitudinally towards the movable slips 120.

In use, movement of the actuating member 140 towards a respective movable slip 120 causes the angled portion 141 of the actuating member 140 to engage the upper angled or tapered surface 121 of the movable slip 120. As the lower sleeve 160 is stationary relative to the mandrel 130 in this configuration, movement of the actuating member 140 towards a respective movable slip 120 causes the lower angled or tapered surface 124 of the movable slip 120 to engage the upper angled portion 161 of the lower sleeve 160. Thus, continuous injection of hydraulic fluid in the annular space 170 forces the movable slip 120 radially outwards towards the bore wall 103*a*. In other words, movement of the actuating member 140 towards a movable slip 120 causes the movable slip 120 to be wedged radially outwards towards the bore wall 103*a*.

It will be appreciated that the force required to fully engage the movable slips 120 with the bore walls 103*a* may vary depending upon the application required for the anchoring apparatus 110, on the type of rock formation, etc. Typically, the force required to fully engage the movable slips 120 with the bore walls 103*a* may be in the range of about 20,000 lbs (9,072 kg) to about 100,000 lbs (45,359 kg), e.g. about 50,000 lbs (22,680 kg).

The anchoring apparatus 110 comprises a unidirectional or "non return" mechanism 177 in the form of a ratchet mechanism, adapted to allow the actuating member 140 to move towards a respective movable slip 120, but prevent movement of the actuating member 140 in the opposite direction. By such provision, the movable slip 120 is prevented from accidentally retracting into its retracted position, thus maintaining the anchoring apparatus 110 in an engaged position in the open hole 103.

Figure 4A:
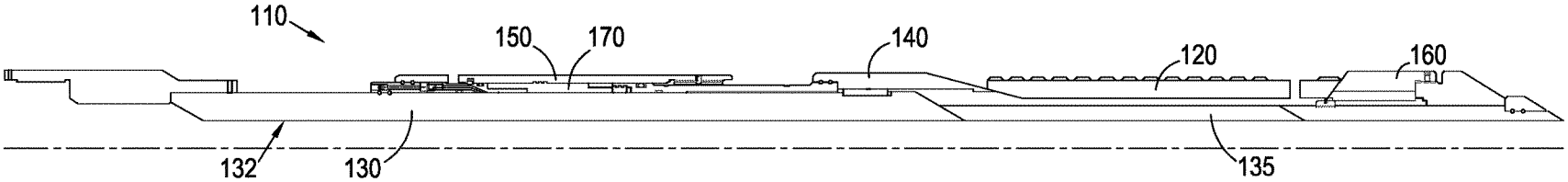
FIG. 4A is a cross-sectional view of the anchoring apparatus of FIG. 1 in a retracted (released) configuration.
Figure 4B:
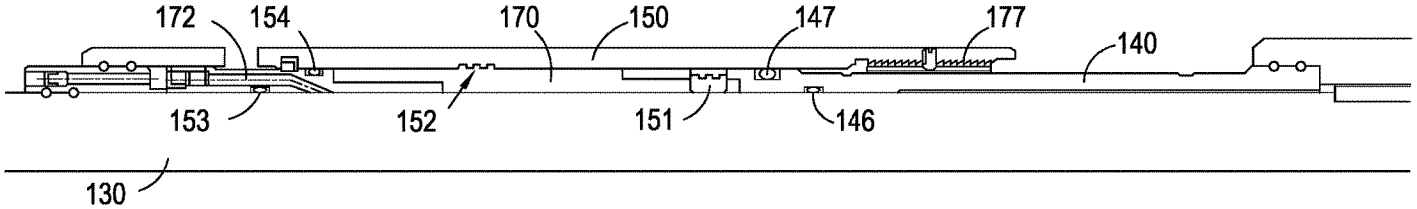
FIG. 4B is an enlarged view of an upper portion of the anchoring apparatus of FIG. 4A.
Figure 4C:
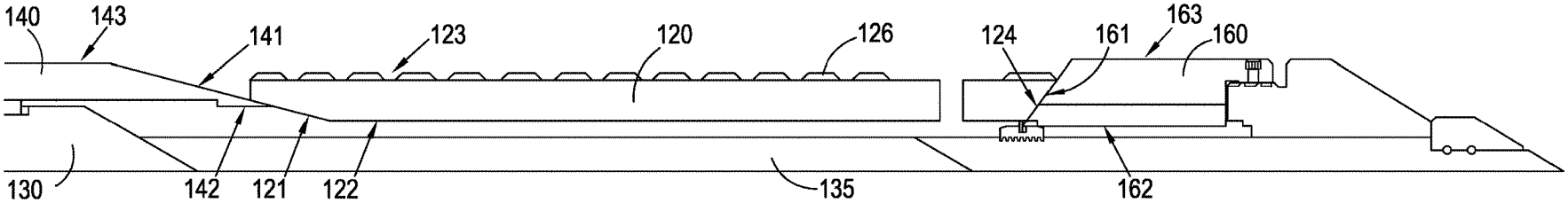
FIG. 4C is an enlarged view of a lower portion of the anchoring apparatus of FIG. 4A.

Referring now to FIGS. 4A, 4B and 4C, there is shown the anchoring apparatus 110 in a retracted (released) configuration.

As mentioned above, the lower sleeve 160 is detachably connected to the mandrel 130. In this embodiment, the lower sleeve 160 is frangibly attached to a connector 165 via a shear pin 167.

In use, when it is desirable to disconnect the movable slips 120 from the bore wall 103*a* and/or retrieve the anchoring apparatus 110 from the open hole 103, a pulling force is applied to the mandrel 130. Application of a predetermined pulling force on the mandrel 130 causes the shear pin 167 to rupture, thus disconnecting the lower sleeve 160 from the mandrel 130. The pulling force required to rupture the shear pin may be above a predetermined value, e.g. above 50 000 lbs (22 680 kg), preferably above 70 000 lbs (31 751 kg).

In use, upon disconnection of the lower sleeve 160 from the mandrel 130, the lower sleeve 160 is capable of moving and/or sliding downwardly, e.g. longitudinally, away from the movable slip 120. In this embodiment showing a substantially vertically arranged anchoring apparatus 110, the lower sleeve 160 is capable of moving away from a respective slip 120 under its own weight. In other embodiments, the lower sleeve 160 may be capable of moving away from a respective slip 120 by application of a force, such as application of fluid pressure by feeding a hydraulic fluid. This may assist in moving the lower sleeve away from the slip 120.

As the lower sleeve 160 is disconnected from the mandrel 130, application of a pulling force on the mandrel 130 causes upwards movement of the mandrel 130 and thus of actuating member 140. However, the lower sleeve 160 does not move upwards with the mandrel 130 because the lower sleeve 160 is now disconnected from the mandrel 130. This movement of the actuating member 140 relative to the lower sleeve 160 increases a distance between the at least one lower sleeve 160 and the actuating member 140, which in turn allows the movable slip 120 to disengage the bore wall 103*a*.

As the mandrel 130 is moved upwards, an upper portion of opening 135 is aligned with an upper portion of slip 120, which may allow evacuation of debris near an upper end of slip 120 to allow inwards movement thereof to disengage bore wall 103*a*.

Figure 5:
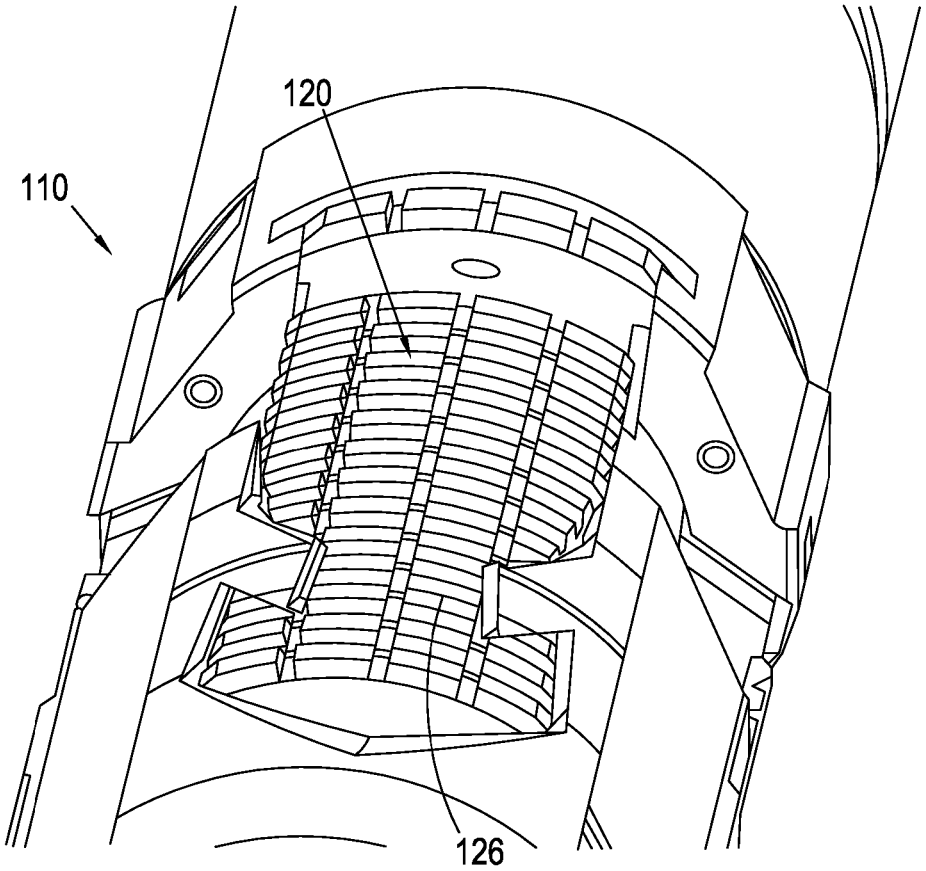
FIG. 5 is a perspective view of an embodiment of the wall engaging elements of the anchoring apparatus of FIG. 1.

Referring now to FIG. 5, there is shown an embodiment of the engaging elements 126 of the movable slips 120, which are configured for engaging, e.g. contacting, penetrating, and/or piercing, the bore wall 103*a*.

In this embodiment, the engaging elements 126 are arranged in parallel rows of teeth.

In another embodiment, the engaging elements 126 may comprise a plurality of first wall surface engaging elements for penetrating a surface of the formation, and a plurality of second wall surface engaging elements for frictionally interacting with a surface of the formation to form an interference engagement with the formation. Such engaging elements are disclosed in International Patent Application Publication No. WO 2006092545 (MACLEOD et al.), which is incorporated here by reference.

Figure 6:
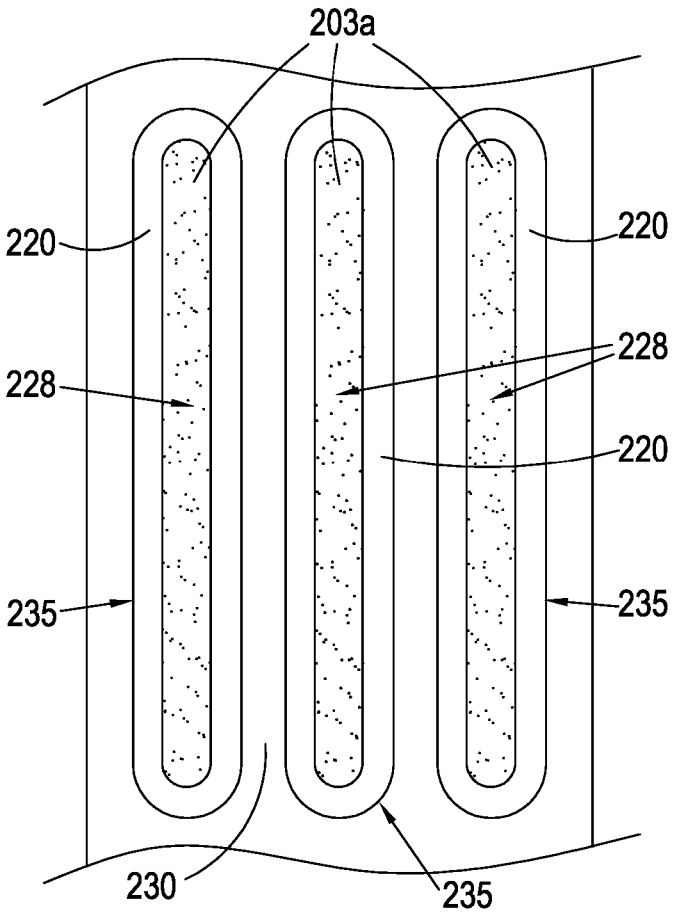
FIG. 6 is a schematic view of an inner side or surface of a mandrel and wall engaging member of an anchoring apparatus according to an embodiment of the present invention, showing openings in the mandrel and wall engaging member.

Referring now to FIG. 6, there is shown a schematic view of a mandrel 230 and slip 220 of an anchoring apparatus according to another embodiment of the present invention, viewed from an inner bore of the anchoring apparatus 210 towards the bore wall 203*a*. The anchoring apparatus of FIG. 6 is generally similar to the anchoring apparatus of FIGS. 1 to 5, like parts denoted by like numerals, incremented by "100".

The slip 220 may be a movable slip, for example as shown in FIGS. 2A to 4C, or may be a stationary slip, e.g. a slip which may be substantially stationary relative to the mandrel 230. In this embodiment the slip 220 is a movable slip.

The slip 220 is provided with a plurality of openings 228. By such provision, any debris generated and accumulated near or around the slips 220 during use of the anchoring apparatus 210, e.g. due to friction and/or pressure of the slips 220 against the rock formation 203*a*, may be evacuated away from the formation surface. This may help prevent accidental damage or malfunction of various parts of the anchoring apparatus 210 and/or surrounding downhole equipment. In this embodiments the openings 228 extend substantially longitudinally relative to the anchoring apparatus 210 and wellbore 203.

The mandrel 230 is also provided with a plurality of openings 235. By such provision, any debris generated and accumulated near or around the slips 220 use of the anchoring apparatus 210, e.g. due to friction and/or pressure of the slips 220 against the bore wall 203*a*, may be evacuated and discarded through openings 228 of the slips 220 and openings 235 of the mandrel, into the wellbore 203.

In this embodiment, the openings 235 of the mandrel 230 are slightly larger than the opening 228 of the slips 220. However, any other relative size arrangement between the openings 235 of the mandrel 230 and the opening 228 of the slips 220 may be adequate so long as it permits evacuation of debris from the bore wall surface 203*a*.

This arrangement allows the movable slips 220 to be moved into their retracted positions when the anchoring apparatus 210 is to be disengaged from the bore wall, without any debris accumulating behind the slips and preventing retraction of the movable slips 220.

Various modifications may be made to the embodiment described without departing from the scope of the invention. For example, whereas the slip of FIG. 6 shows a movable slip, it will be appreciated that the provision of openings in the slip and mandrel may be equally applicable and advantageous when use with stationary slips.

The invention claimed is:

1. An anchoring apparatus for use in an openhole wellbore having a wall, the anchoring apparatus comprising:

a mandrel having an uphole end and a downhole end, the mandrel having external recesses defined on an outer surface of the mandrel;

at least one movable wall engaging member configured to engage the wall of the openhole wellbore;

at least one lower sleeve located downhole relative to the at least one moveable wall engaging member and configured to contact the at least one movable wall engaging member at or near an upper end of the at least one lower sleeve; and at least one actuating member located uphole relative to the at least one moveable wall engaging member and configured to move downwardly downhole and longitudinally relative to the mandrel, for moving the at least one movable wall engaging member from a retracted position to an expanded position;

wherein the at least one movable wall engaging member is movable from the retracted position to the expanded position to engage the wall, wherein the at least one lower sleeve is detachably connected to a connector disposed between the at least one lower sleeve and the mandrel, the connector having internal protrusions engaged with the external recesses of the mandrel, wherein the at least one lower sleeve is held stationary by the connector relative to the mandrel during deployment of the at least one movable wall engaging member from the retracted position to the expanded position, wherein the at least one lower sleeve is configured to detach from the connector and is configured to release the at least one movable wall engaging member from the expanded position to the retracted position to disengage the wall, and wherein the anchoring apparatus comprises a unidirectional or—non return—mechanism adapted to allow the at least one actuating member to move towards a respective one of the at least one movable wall engaging member, and prevent movement of the at least one actuating member in an opposite direction.

2. The anchoring apparatus of claim 1, wherein the at least one movable wall engaging member is movable from a first of the retracted position to the expanded position to engage the wall, and is movable from the expanded position to a second of the retracted position to disengage the wall; and wherein the first and second retracted positions are different.

3. The anchoring apparatus of claim 1, wherein the anchoring apparatus comprises a plurality of the at least one movable wall engaging member, and wherein the movable wall engaging members are circumferentially arranged relative to the anchoring apparatus and/or wellbore.

4. The anchoring apparatus of claim 1, wherein the anchoring apparatus comprises one of:

a plurality of the at least one movable wall engaging member; and at least one stationary wall engaging member.

5. The anchoring apparatus of claim 1, wherein the at least one movable wall engaging member comprises a first angled or tapered surface at or near a first end thereof, the first angled or tapered surface extending from an inner portion thereof to an outer portion thereof; and/or wherein the at least one movable wall engaging member comprises a second angled or tapered surface at or near a second end thereof, the second angled or tapered surface extending from an inner portion thereof to an outer portion thereof.

6. The anchoring apparatus of claim 1, wherein the at least one movable wall engaging member is radially movable relative to a housing and/or a mandrel of the apparatus.

7. The anchoring apparatus of claim 1, wherein the at least one actuating member comprises a cam structure configured for engaging an upper angled or tapered surface of the at least one movable wall engaging member.

8. The anchoring apparatus of claim 1, wherein the mandrel defines an inner portion or inner surface of the anchoring apparatus.

9. The anchoring apparatus of claim 1, wherein the anchoring apparatus comprises at least one outer sleeve located on an upper side relative to the at least one movable wall engaging member; and wherein the mandrel and the at least one outer sleeve define an annular space in which a respective actuating member is capable of moving longitudinally.

10. The anchoring apparatus of claim 1, wherein in a first retracted configuration, the at least one actuating member is detachably attached to an at least one outer sleeve.

11. The anchoring apparatus of claim 10, wherein, in use, the at least one actuating member is detachable from the at least one outer sleeve by application of a load on the at least one actuation member.

12. The anchoring apparatus of claim 1, wherein, in use, application of a pulling force on the mandrel causes uphole movement of the mandrel and thus of a respective one of the at least one actuating member, allowing the respective movable wall engaging member to disengage the wall.

13. The anchoring apparatus of claim 1, wherein the mandrel of the apparatus is provided with or comprises one or more first openings.

14. The anchoring apparatus of claim 13, wherein the one or more first openings of the mandrel are similar in size or larger than one or more second openings of the at least one movable wall engaging member.

15. A method for disengaging an anchoring apparatus according to claim 1 from a wall of an openhole wellbore, the method comprising:

moving the at least one movable wall engaging member from the expanded position in which the at least one movable wall engaging member engages the wall, to the retracted position in which the at least one movable wall engaging member disengages the wall.

16. The method of claim 15, wherein the at least one lower sleeve is connected to the connector by a frangible connection.

17. The anchoring apparatus of claim 1, wherein the at least one lower sleeve is connected to the connector by a frangible connection.

18. An anchoring apparatus for use in an openhole wellbore having a wall, the anchoring apparatus comprising:

a mandrel having an uphole end and a downhole end, the mandrel having external recesses defined on an outer surface of the mandrel;

at least one movable wall engaging member configured to engage the wall of the openhole wellbore;

at least one lower sleeve located downhole relative to the at least one moveable wall engaging member and configured to contact the at least one movable wall engaging member at or near an upper end of the at least one lower sleeve; and at least one actuating member located uphole relative to the at least one moveable wall engaging member and configured to move downwardly downhole and longitudinally relative to the mandrel, for moving the at least one movable wall engaging member from a retracted position to an expanded position;

wherein the at least one actuating member is movable by hydraulic actuation, wherein the at least one movable wall engaging member is movable from the retracted position to the expanded position to engage the wall, wherein the at least one lower sleeve is detachably connected to a connector disposed between the at least one lower sleeve and the mandrel, the connector having internal protrusions engaged with the external recesses of the mandrel, wherein the at least one lower sleeve is held stationary by the connector relative to the mandrel during deployment of the at least one movable wall engaging member from the retracted position to the expanded position, and wherein the at least one lower sleeve is configured to detach from the connector and is configured to release the at least one movable wall engaging member from the expanded position to the retracted position to disengage the wall.

* * * * *